US007272927B2

(12) United States Patent
Geminn et al.

(10) Patent No.: US 7,272,927 B2
(45) Date of Patent: Sep. 25, 2007

(54) AIR GAP-INSULATED EXHAUST MANIFOLD FOR INTERNAL COMBUSTION ENGINES

(75) Inventors: Markus Geminn, St. Martin (DE); Andreas Steigert, Lambrecht (DE); Margit Roth, Freimersheim (DE)

(73) Assignee: Heinrich Gillet GmbH, Edenkoben (DE)

( * ) Notice: Subject to any disclaimer, the term of this patent is extended or adjusted under 35 U.S.C. 154(b) by 249 days.

(21) Appl. No.: 10/980,647

(22) Filed: Nov. 3, 2004

(65) Prior Publication Data

US 2005/0097886 A1 May 12, 2005

(30) Foreign Application Priority Data

Nov. 7, 2003 (DE) ..... 203 17 115
Mar. 9, 2004 (DE) ..... 10 2004 011 323

(51) Int. Cl.
*F01N 3/00* (2006.01)

(52) U.S. Cl. ..... 60/323; 60/322

(58) Field of Classification Search ..... 60/313, 60/321, 323, 322, 324
See application file for complete search history.

(56) References Cited

U.S. PATENT DOCUMENTS 5,682,741 A * 11/1997 Augustin et al. ..... 60/323
5,784,882 A * 7/1998 Bonny et al. ..... 60/323
6,082,104 A * 7/2000 Hyakutake et al. ..... 60/323
6,254,142 B1 * 7/2001 Kaifel et al. ..... 285/124.1
6,427,440 B1 * 8/2002 Bonny et al. ..... 60/323
6,523,343 B2 * 2/2003 Durr et al. ..... 60/323
6,789,386 B1 * 9/2004 Haerle ..... 60/323

FOREIGN PATENT DOCUMENTS

| | | |
|---|---|---|
| DE | 725013 | 9/1942 |
| DE | 19628797 | 1/1998 |
| DE | 10001287 | 2/2001 |
| EP | 0582985 | 2/1994 |
| EP | 0671551 | 9/1995 |

* cited by examiner

*Primary Examiner*—Thomas Denion
*Assistant Examiner*—Diem Tran
(74) *Attorney, Agent, or Firm*—Klaus P. Stoffel; Wolff & Samson PC

(57) ABSTRACT

An air gap-insulated exhaust manifold for internal combustion engines. The manifold includes a flange with openings for fastening elements and further openings, which align with the cylinder exhaust ports of the internal combustion engine. A gas-tight outer shell is connected to the flange. An inner shell is provided with openings, which align with the cylinder exhaust ports of the internal combustion engine. The outer shell has a trough-shaped lower part and a hood-shaped upper part, which is welded gas-tight to the lower part. The inner shell has a trough-shaped lower part and a hood-shaped upper part. The outer shell is connected to the flange in a gas-tight manner. The inner shell is firmly attached to the outer shell at only one place.

10 Claims, 2 Drawing Sheets

AIR GAP-INSULATED EXHAUST MANIFOLD FOR INTERNAL COMBUSTION ENGINES

BACKGROUND OF THE INVENTION

The invention relates to an air gap-insulated exhaust manifold for internal combustion engines.

Exhaust manifolds have the job of collecting the hot exhaust gases emerging from the cylinder exhaust ports of internal combustion engines and of conducting them to the downstream exhaust system components such as catalysts, mufflers, etc. The temperature of these gases subjects the manifold to high thermal loads. In an initial attempt to reduce the amount of heat discharged to the outside, exhaust manifolds were provided with water cooling systems. An example is described in DE 725 013 C1. In the development of this water-cooled exhaust manifold, special value was placed on the ability to compensate for the changes in the length of the various metal parts caused by the different degrees to which they are heated. This goal is achieved by the use of built-in sliding seats. Stuffing-box seals are provided at the points where the muffler brackets pass with play through the cooling jacket. These seals are designed so that any water which might leak out can escape only to the outside.

In recent times, exhaust manifolds have also been designed with air-gap insulation. A first example is described in EP 0 582 985 B. This exhaust manifold is formed by a flat flange, by an outer shell welded to the flange, and by an inner shell. The inner shell is welded to the outer shell and to the flange and is centered and held in place by wire rings in the outer shell. The inner shell is mounted in sliding seats located between the cylinder exhaust ports. The inner shell thus consists of a plurality of individual parts, which means that both production and assembly become more difficult and more expensive.

Another exhaust manifold is known from EP 0 671 551 A. This exhaust manifold consists of a flange, an outer shell, and an inner shell. The longitudinal edges of the outer shell are welded to the flange. The longitudinal edges of the inner shell rest loosely and elastically on the edges of the outer shell. No sliding seats or other means for compensating for the differences in length between the inner shell and the outer shell caused by different degrees of heating are provided.

Another air gap-insulated exhaust manifold is known from DE 196 28 797 C. This exhaust manifold has individual flanges for each cylindrical exhaust port, an outer shell, and an inner shell. The inner shell consists of a plurality of parts, and sliding seats are provided between the cylinder exhaust ports. In addition, a support cage is provided, which is positioned in the intermediate space between the inner and outer shells. This makes the exhaust manifold extremely complicated. The support cage also reduces the insulating effect of the air gap.

An air gap-insulated exhaust manifold with an inner shell consisting of two parts, a bottom with exhaust openings, and a loosely seated hood is known from DE 100 01 287 A. The inner shell is held in place by U-shaped straps, which are positioned in the air gap between the inner shell and the outer shell. The cross section of the outer shell is more-or-less omega-shaped. The outer shell, the retaining straps, the inner shell, and the flange are screwed to the engine block by way of an intermediate gasket. The disadvantage is the reduction in the insulating effect of the air gap caused by the retaining straps and by the large mounting surface on the engine block.

SUMMARY OF THE INVENTION

It is the object of the present invention to provide an exhaust manifold of the type indicated above which consists of only a few individual parts and which can be easily assembled in an almost completely automated manner.

One aspect of the present invention results in an air gap-insulated exhaust manifold having a flange with first openings for fastening elements and second openings which are arranged to align with cylinder exhaust ports of an internal combustion engine. The exhaust manifold further has a gas-tight outer shell connected to the flange in a gas-tight manner. The outer shell includes a trough-shaped lower part with openings arranged to align with the cylinder exhaust ports of the internal combustion engine, and a hood-shaped upper part. The lower part and the upper part are welded together in a gas-tight manner. The exhaust manifold further has an inner shell with a trough-shaped lower part having openings arranged to align with the cylinder exhaust ports and a hood-shaped upper part. The lower part and the upper part are connected to each other. The inner shell is attached at only one point to the outer shell.

In another embodiment of the invention, the outer shell is connected in a gas-tight manner to the flange by welds that encircle the openings in the lower part of the outer shell.

The inner shell is attached to the outer shell by a single weld that encircles one of the openings in the lower part of the inner shell in another embodiment of the invention. If desired, the single weld can attach the inner shell and the outer shell to the flange.

In still another embodiment, the openings in the inner shell which do not have the weld have a larger diameter than the welded opening.

A further embodiment of the invention provides tabs formed on the outer shell in an area of one of the openings of the inner shell which has no weld. The tabs are bent over onto the lower part of the inner shell to form a sliding seat.

In an alternative embodiment, a tab is formed on the outer shell in an area of one of the openings in the inner shell which has no weld and is guided across the lower part of the inner shell all the way to one of the openings in the lower part of the inner shell. The tab is welded to the outer shell and forms a sliding seat.

In still another embodiment of the invention, projections are formed on the upper part of the inner shell and the upper part of the outer shell is arranged to rest on the projections to produce a sliding seat.

Yet another embodiment of the invention has an insulating air gap between the lower part of the outer shell and the lower part of the inner shell in certain areas.

Yet another embodiment of the invention provides rim holes formed in the upper part of the outer shell and/or the upper part of the inner shell as pipe connector sockets.

A first essential advantage of the inventive exhaust manifold is that it consists of only five individual parts. Another advantage is that both the inner shell and the outer shell have closed surfaces, which makes them extremely sturdy. In addition, the welds between the lower and upper parts of the inner and outer shells can be positioned in such a way that there is no danger that weld spatters can remain in the exhaust-carrying parts. The mounting surface area of the exhaust manifold on the engine block is minimal. Free spaces to accommodate the fastening screws can be easily formed in the inner and outer shells. Generally, the inventive exhaust manifold is mounted on the engine block in exactly the same way as the current method.

The inner shell occupies a defined position, and the differences in thermal expansion are fully compensated.

Other features and advantages of the present invention will become apparent from the following description of the invention which refers to the accompanying drawings.

BRIEF DESCRIPTION OF THE DRAWINGS

The invention is explained in greater detail below on the basis of an exemplary embodiment, which is illustrated in the drawing. In the form of purely schematic, partial views.

DETAILED DESCRIPTION OF THE INVENTION

Figure 2:
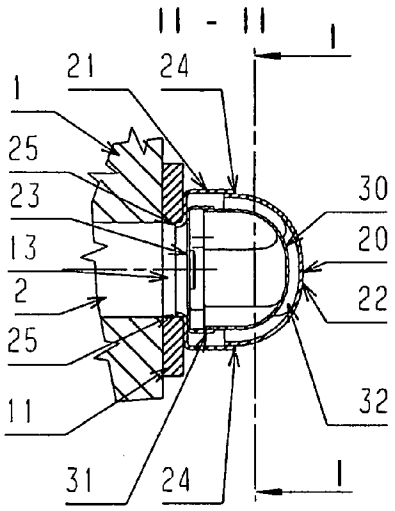
FIG. 2 shows a cross section through the exhaust manifold of FIG. 1 along line II-II of FIG. 1.
Figure 1:
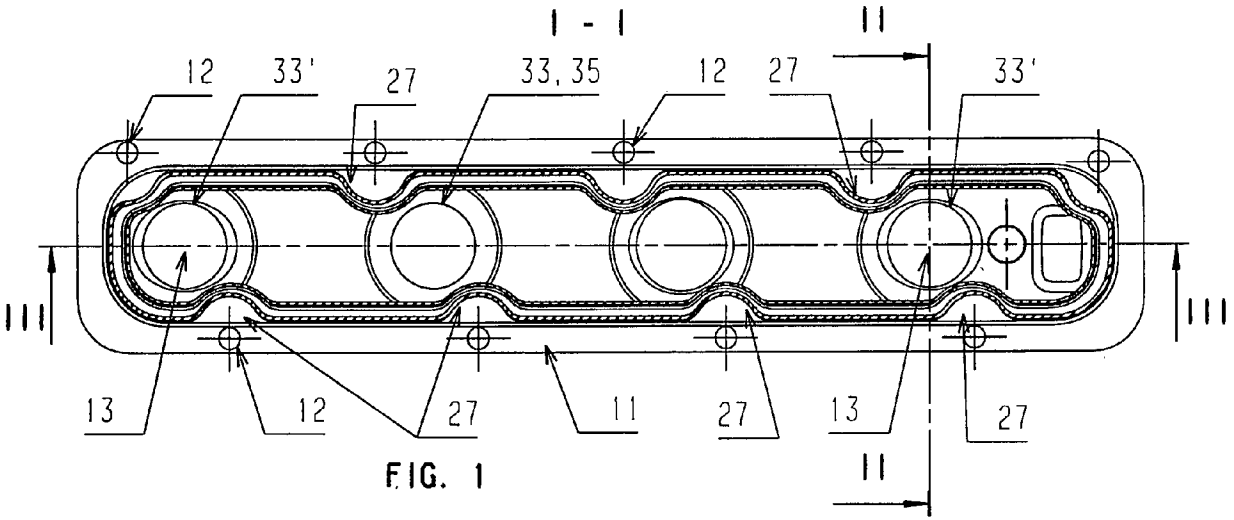
FIG. 1 shows a longitudinal cross section through an air gap-insulated exhaust manifold along line I-I of FIG. 2.
Figure 3:
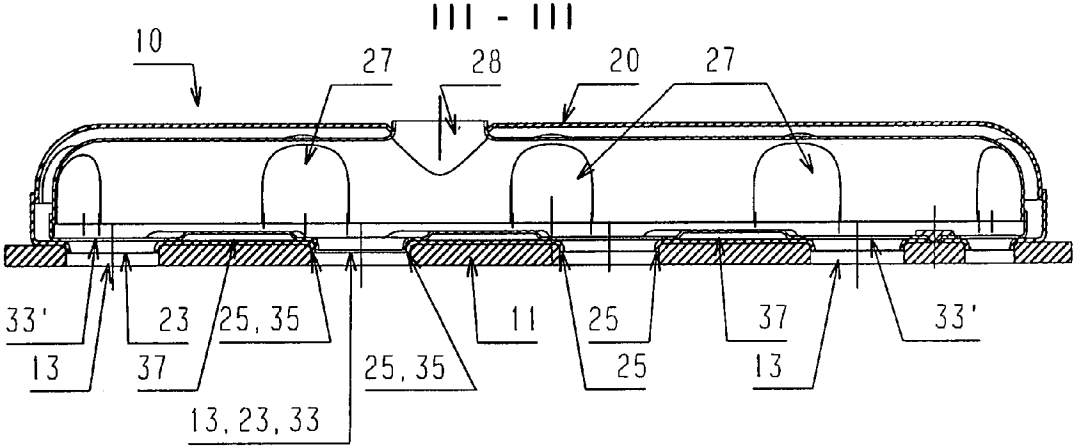
FIG. 3 shows a longitudinal section through the exhaust manifold of FIGS. 1 and 2 along line III-III of FIG. 1.

In the form of three orthogonal cross sections along lines I-I, II-II, and III-III, FIGS. 1-3 show parts of an air gap-insulated exhaust manifold 10 for internal combustion engines.

The basis of the manifold 10 is a sturdy flange 11 with openings 12 for fastening screws and with gas through-openings 13, which are aligned with the cylinder exhaust ports 2 of the internal combustion engine 1.

A trough-shaped lower part 21 of an outer shell 20 is first attached in a gas-tight manner to the flange 11. The lower part 21 has gas through-openings 23, which align with the gas through-openings 13 in the flange 11 and in the cylinder head of the engine. To produce a gas-tight seal, the gas through-openings 13, 23 are provided with circular welds 25. Laser stitch welding is especially suitable for this purpose, because no welding spatters are created.

An inner shell 30 is placed inside the trough-like lower part 21 of the outer shell 20. The inner shell 30 consists of a trough-like lower part 31 and a hood-shaped upper part 32, which is attached to the lower part 31. The lower part 31 has gas through-openings 33, 33', which align with the gas through-openings 13, 23 in the flange 11 and in the outer shell 20. The inner shell 30 is fastened to the outer shell 20 and to the flange 11 by only a single weld 35, which encircles one of the gas through-openings 33'. The weld 35 can preferably coincide with one of the welds 25, by means of which the outer shell 20 is welded gas-tight to the flange 11. The other parts of the inner shell 30 are able to move freely with respect to the outer shell 20 in correspondence with the thermally-caused differences in expansion.

Figure 7:
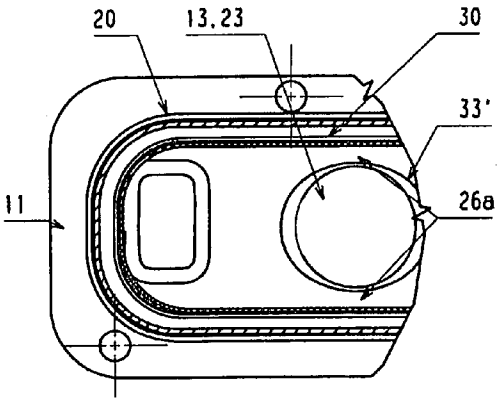
FIG. 7 shows part of a longitudinal section through a fifth embodiment.

If it should prove necessary to anchor the inner shell 30 to the outer shell 20 without impeding the thermal compensation, this can be done in the manner shown in FIG. 7 with the help of sheet-metal tabs 26*a*, which are provided on the lower part 21 of the outer shell 20 in the area of the gas through-opening 23 and which are bent up and over after the lower part 31 of the inner shell has been set in place.

As soon as the lower part 21 of the outer shell 20 and the lower part 31 of the inner shell 30 have been fastened to the flange 11, the upper part 32 of the inner shell 30 is set down and fixed to the lower part 31. This connection does not have to be gas-tight. Then a hood-like upper part 22 of the outer shell 20 is set down on the lower part 21 and welded in place by means of a surrounding weld 24 in a gas-tight manner. The weld 24 is on the outside surface of the outer shell 20, so that any spatters which may be formed cannot intrude into the gas-carrying spaces.

Rim holes 28, to which exhaust pipes (not shown) are attachable, can be formed in the upper parts 22, 32 of the outer and/or inner shells 20, 30.

FIG. 3 also shows that, by means of the appropriate shaping of the sheet-metal parts, the possibility exists of producing, at least in certain areas, an insulating air gap 37 between the lower part 31 of the inner shell 30 and the lower part 21 of the outer shell 20 and the flange 11.

Figure 4:
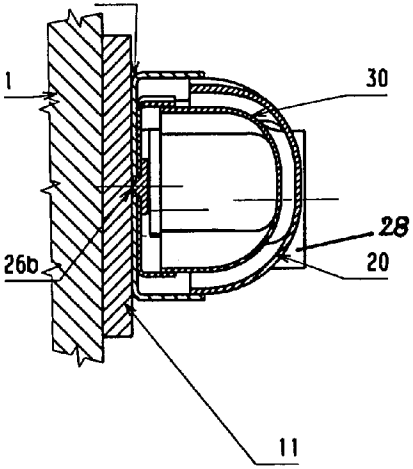
FIG. 4 shows a cross section through a second embodiment.

Another way in which the inner shell 30 can be attached to the outer shell 20 is shown in FIG. 4. Here a hole is provided in the lower part 21 of the outer shell 20, and a slot is provided in the lower part 31 of the inner shell 30. A bolt 26*b* is inserted through the slot and through the hole in the lower part 21 of the outer shell 20 and then welded gas-tight from the outside, so that the inner shell 30 can shift in the slot but is held on the lower part 21 of the outer shell 20 by the bolt 26*b*.

Figure 5:
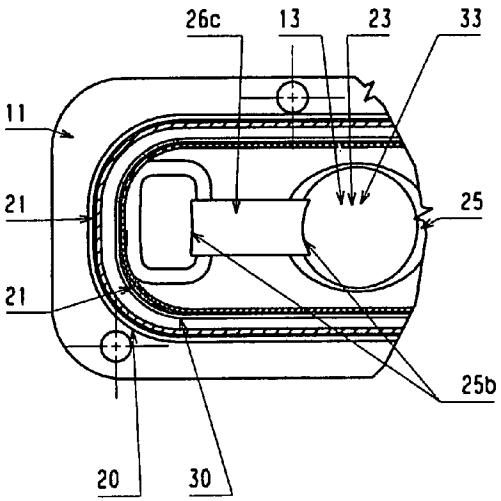
FIG. 5 shows part of a longitudinal section through a third embodiment.

The inner shell 30 can also be attached to the outer shell 20 by a tab 26*c*, as shown in FIG. 5. Here the tab 26*c* is arranged so that it projects into the flange 11 and the lower part 21 of the outer shell 20 at two adjacent gas exhaust ports 23. The tab 26*c* can then be welded there to the lower part 21 of the outer shell 20. This weld 25*b* can preferably coincide with one of the welds 25, by means of which the outer shell 20 is connected gas-tight to the flange 11. The tab 26*c* now holds the inner shell 30 on the lower part 21 of the outer shell 20, while the ability of the inner shell 30 to shift is ensured by the fact that the gas through-openings 33 in the lower part 31 of the inner shell 30 are larger than the gas through-openings 13, 23 in the flange 11 and in the outer shell 20.

Figure 6:
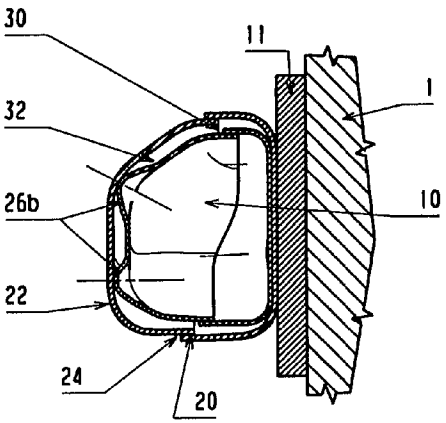
FIG. 6 shows a cross section through a fourth embodiment.

The inner shell 30 can also be anchored in the outer shell 20 as shown in FIG. 6. Here projections 26*d* are pressed into the upper part 32 of the inner shell 30. When the upper part of the outer shell 20 is set on and welded to the manifold 10 by the weld 24, the upper part 22 of the shell 20 is pretensioned in such a way that the projections 26*d* rest without gaps and thus with pretension against the upper part 22. As a result of the pressure thus exerted, the inner shell 30 is guided on the outer shell 20 without loss of its ability to shift. The projections 26*d* can be fashioned without extra expense during the deep-drawing of the upper part 32 of the inner shell 30.

As the figures clearly show, it is easy during the shaping of the outer and inner shells 20, 30 to provide sufficiently large free spaces 27 to accommodate the fastening screws or bolts by which the exhaust manifold is attached to the internal combustion engine 1. Overall, an air gap-insulated exhaust manifold for internal combustion engines of a wide variety of types is thus obtained which is very compact, very inexpensive to fabricate because of the geometry of its components, sturdy, and obtainable in almost any shape Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An air gap-insulated exhaust manifold for an internal combustion engine, comprising:

a flange with first openings for fastening elements and second openings which are arranged to align with cylinder exhaust ports of the internal combustion engine;

a gas-tight outer shell connected to the flange in a gas-tight manner, the outer shell including a trough-shaped lower part with openings arranged to align with the cylinder exhaust ports of the internal combustion engine, and a hood-shaped upper part, the lower part and the upper part being welded together in a gas-tight manner;

an inner shell having a trough-shaped lower part with openings arranged to align with the cylinder exhaust ports and a hood-shaped upper part, the lower part and the upper part being connected to each other, the inner shell being welded at only one place to a base of the outer shell, wherein the openings in the inner shell which do not have the weld have a larger diameter than the welded opening; and tabs formed on the outer shell in an area of one of the openings in the inner shell which has no weld, the tabs being bent over onto the lower part of the inner shell to form a sliding seat.

2. The exhaust manifold according to claim 1, wherein the outer shell is connected in a gas-tight manner to the flange by welds that encircle the openings in the lower part of the outer shell.

3. The exhaust manifold according to claim 1, wherein an insulating air gap between the lower part of the outer shell and the lower part of the inner shell is present in distinct areas.

4. The exhaust manifold, according to claim 1, wherein the inner shell is attached to the outer shell by a single weld that encircles one of the openings in the lower part of the inner shell.

5. The exhaust manifold according to claim 4, wherein the single weld attaches the inner shell and the outer shell to the flange.

6. An air gap-insulated exhaust manifold for an internal combustion engine, comprising:

a flange with first openings for fastening elements and second openings which are arranged to align with cylinder exhaust ports of the internal combustion engine;

a gas-tight outer shell connected to the flange in a gas-tight manner, the outer shell including a trough-shaped lower part with openings arranged to align with the cylinder exhaust ports of the internal combustion engine, and a hood-shaped upper part, the lower part and the upper part being welded together in a gas-tight manner;

an inner shell having a trough-shaped lower part with openings arranged to align with the cylinder exhaust ports and a hood-shaped upper part, the lower part and the upper part being connected to each other, the inner shell being welded at only one place to a base of the outer shell, wherein the openings in the inner shell which do not have the weld have a larger diameter than the welded opening; and a tab formed on the outer shell in an area of one of the openings in the inner shell which has no weld, the tab being guided across the lower part of the inner shell all the way to one of the openings in the lower part and is welded to the outer shell to form a sliding seat.

7. An air gap-insulated exhaust manifold for an internal combustion engine, comprising:

a flange with first openings for fastening elements and second openings which are arranged to align with cylinder exhaust ports of the internal combustion engine;

a gas-tight outer shell connected to the flange in a gas-tight manner, the outer shell including a trough-shaped lower part with openings arranged to align with the cylinder exhaust ports of the internal combustion engine, and a hood-shaped upper part, the lower part and the upper part being welded together in a gas-tight manner;

an inner shell having a trough-shaped lower part with openings arranged to align with the cylinder exhaust ports and a hood-shaped upper part, the lower part and the upper part being connected to each other, the inner shell being welded at only one place to a base of the outer shell, wherein the openings in the inner shell which do not have the weld have a larger diameter than the welded opening; and projections formed on the upper part of the inner shell, the upper part of the outer shell being arranged to rest on the projections to produce a sliding seat.

8. An air gap-insulated exhaust manifold for an internal combustion engine, comprising:

a flange with first openings for fastening elements and second openings which are arranged to align with cylinder exhaust ports of the internal combustion engine;

a gas-tight outer shell connected to the flange in a gas-tight manner, the outer shell including a trough-shaped lower part with openings arranged to align with the cylinder exhaust ports of the internal combustion engine, and a hood-shaped upper part, the lower part and the upper part being welded together in a gas-tight manner; and an inner shell having a trough-shaped lower part with openings arranged to align with the cylinder exhaust ports and a hood-shaped upper part, the lower part and the upper part being connected to each other, the inner shell being welded at only one place to a base of the outer shell, wherein the openings in the inner shell which do not have the weld have a larger diameter than the welded opening, wherein rim holes are formed in the upper part of the outer shell as pipe connector sockets.

9. An air gap-insulated exhaust manifold for an internal combustion engine, comprising:

a flange with first openings for fastening elements and second openings which are arranged to align with cylinder exhaust ports of the internal combustion engine;

a gas-tight outer shell connected to the flange in a gas-tight manner, the outer shell including a trough-shaped lower part with openings arranged to align with the cylinder exhaust ports of the internal combustion engine, and a hood-shaped upper part, the lower part and the upper part being welded together in a gas-tight manner; and an inner shell having a trough-shaped lower part with openings arranged to align with the cylinder exhaust ports and a hood-shaped upper part, the lower part and the upper part being connected to each other, the inner shell being welded at only one place to a base of the outer shell, wherein the openings in the inner shell which do not have the weld have a larger diameter than the welded opening, wherein rim holes are formed in the upper part of the inner shell as pipe connector sockets.

10. An air gap-insulated exhaust manifold for an internal combustion engine, comprising:

a flange with first openings for fastening elements and second openings which are arranged to align with cylinder exhaust ports of the internal combustion engine;

a gas-tight outer shell connected to the flange in a gas-tight manner, the outer shell including a trough-shaped lower part with openings arranged to align with the cylinder exhaust ports of the internal combustion engine, and a hood-shaped upper part, the lower part and the upper part being welded together in a gas-tight manner; and an inner shell having a trough-shaped lower part with openings arranged to align with the cylinder exhaust ports and a hood-shaped upper part, the lower part and the upper part being connected to each other, the inner shell being welded at only one place to a base of the outer shell, wherein the openings in the inner shell which do not have the weld have a larger diameter than the welded opening, wherein the rim holes are formed in the upper parts of the outer and inner shells as pipe connector sockets.

* * * * *